US005100156A

United States Patent [19]

Mayne

[11] Patent Number: 5,100,156

[45] Date of Patent: Mar. 31, 1992

[54] GAME APPARATUS

[75] Inventor: Geoffrey P. Mayne, Birmingham, Great Britain

[73] Assignee: Granta Design Limited, London, England

[21] Appl. No.: 548,975

[22] PCT Filed: Feb. 3, 1989

[86] PCT No.: PCT/GB89/00105

§ 371 Date: Aug. 3, 1990

§ 102(e) Date: Aug. 3, 1990

[87] PCT Pub. No.: WO89/06999

PCT Pub. Date: Aug. 10, 1989

[30] Foreign Application Priority Data

Feb. 6, 1988 [GB] United Kingdom ..... 8802724

[51] Int. Cl.[5] ..... A63F 7/00

[52] U.S. Cl. ..... 273/457

[58] Field of Search ..... 273/1 L, 457

[56] References Cited

U.S. PATENT DOCUMENTS 3,077,697 2/1963 Fry ..... 273/1 L X 3,924,350 12/1975 Hsu ..... 273/1 L X

FOREIGN PATENT DOCUMENTS 2913469 10/1980 Fed. Rep. of Germany ..... 273/1 L 1202602 1/1986 U.S.S.R. ..... 273/1 L

*Primary Examiner*—Paul E. Shapiro

[57] ABSTRACT

Game apparatus comprises a generally cylindrical transparent chamber (12) containing liquid and having a series of game elements (42, 44) within the chamber for actuation by means of a pair of bellows-type pumps (26,28) whereby the game elements can be moved within the chamber and, by judicial use of the pumps, collected into a target area (56). One of the game elements (44) is of variable buoyancy. By simultaneous application of pressure from both pumps, the variable buoyancy element can be caused to descend and pick up one of the other game elements for transportation to the target area. Liquid discharged by the pumps into the chamber also causes movement of the game elements by its momentum.

9 Claims, 2 Drawing Sheets

GAME APPARATUS

This invention relates to game apparatus. In an embodiment described below, such apparatus comprises a generally cylindrical transparent water-containing chamber in which the player causes game elements to move onto a target in accordance with the rules of the game.

In previously proposed apparatus of this general kind, there have been limitations with respect to the manner in which the game elements can be moved within the chamber. Generally speaking, it has only been possible to employ gravity and/or a jet of water to achieve movement of the game elements within the chamber by virtue of the momentum of the water. This is all very well in itself, but is rather limited in its scope and an object of the invention is to provide game apparatus offering improvements in this regard and/or improvements generally.

According to the invention there is provided game apparatus as defined in the accompanying claims.

In an embodiment described below, a pair of pumps are each connected to a water-containing chamber for sequential or simultaneous operation. Optional non-return valves may be provided to control water flow. The direction of liquid discharge from each pump causes liquid circulation in the chamber in opposite directions. Thus, according to which pump is used, water in the chamber may rotate clockwise or anti-clockwise.

The water (or other liquid) chamber is filled through a filler hole, and during the filling each pump is pressed up and down to exclude all air. When the chamber and pumps are totally filled with water, one pump is compressed. The water in this pump escapes from the filler hole, which is then closed. Both pumps then adjust to a half-full condition. Thereafter simultaneous compression of the pumps raises pressure in the chamber for a purpose to be described. Sequential compression causes water circulation in a chosen direction.

A game element or float of variable buoyancy is located in the chamber for movement both by the directional flow of water therein and by the effect of pressure changes on its buoyancy. The game element is hollow, with air trapped inside it. The flat outer walls of it may be thin enough to be resiliently pushed in by the pressure, thus compressing the air inside. Alternatively the game element may have an opening whereby the water pressure acts directly on a bubble of air trapped inside it. Such pressure is provided in the main chamber by simultaneous actuation of both pumps, which compresses the air inside the float, reducing its buoyancy, and causes it to sink. When the users relieves the pressure the float tends to rise. Its depth can therefore be controlled by the pressure applied. Directional momentum can be applied to the game element by virtue of fluid flow caused by using one or both pumps individually or in sequence. The game element or float is weighted so that a hook is always at its lower periphery, thus enabling it to pick up other game elements by engaging hooks thereon, whereby it can transport same to a target area or otherwise.

In certain embodiments provision is made for magnetic interaction of the game elements either in the same chamber or in different chambers.

An embodiment of the invention will now be described by way of example with reference to the accompanying drawings in which.

Figure 1:
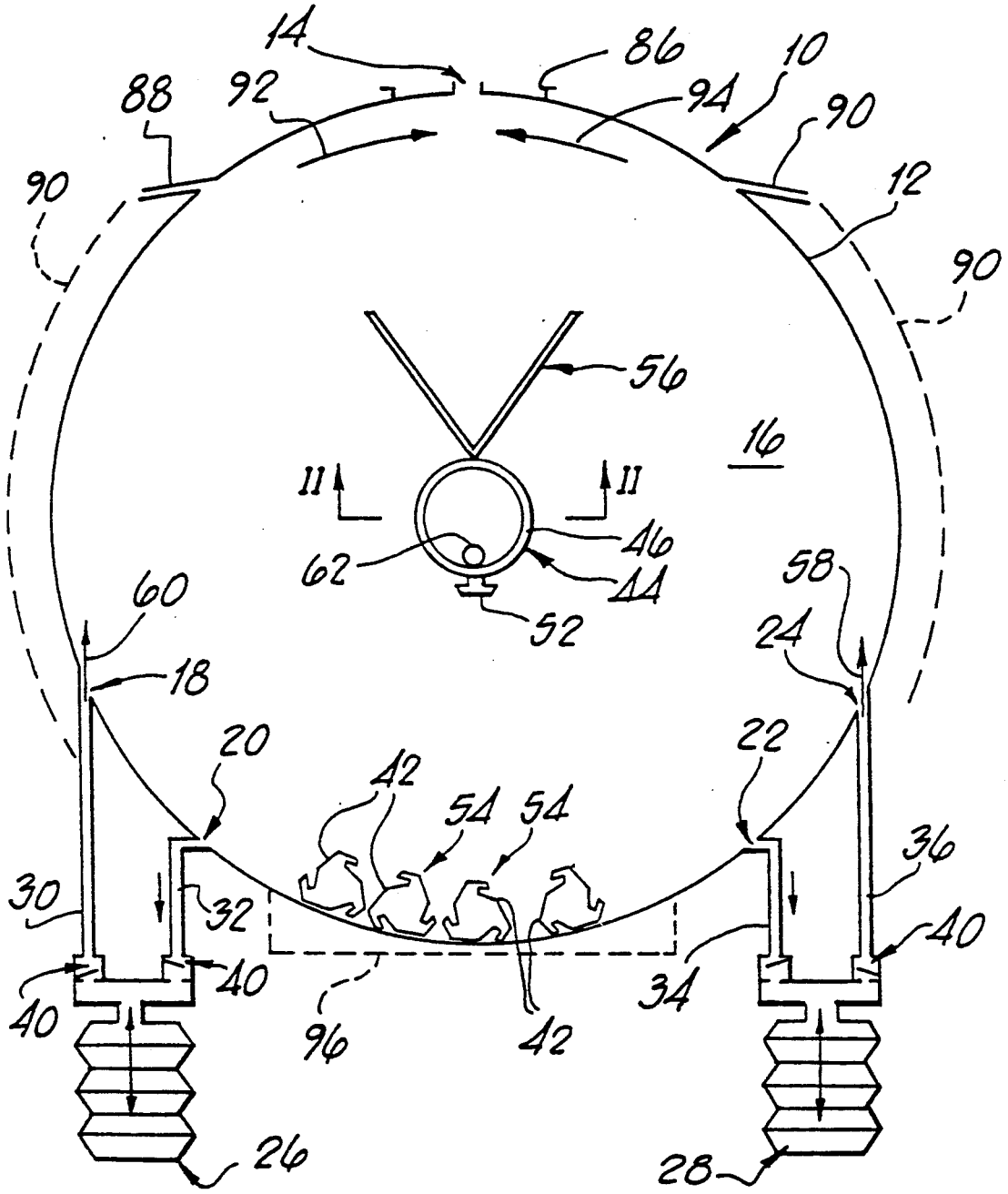
FIG. 1 shows a side elevation view of game apparatus in its normal operating attitude.
Figure 2:
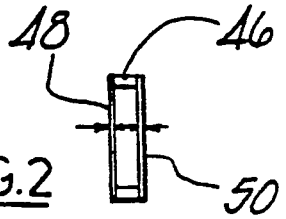
FIG. 2 shows a section on the line II—II in FIG. 1 through a variable buoyancy game element.

Game apparatus 10 comprises a chamber 12 of generally cylindrical form having a filler hole 14, generally flat opposite side faces 16 of which one or both may be transparent for viewing purposes, and ports 18, 20, 22 and 24 connected to resilient bellows-type pumps 26 and 28 by ducts 30, 32, 34 and 36. Non-return flap valves 40 are associated with the connections of each pump to ensure that the tangentially disposed ducts 30 and 36 always discharge, and the more radially directed ducts (at least so far as their end portions are concerned) 32 and 34 always (or mainly) take water in.

A suitable backdrop can be provided on the rearmost (non-viewing) flat face of chamber 12. Within the chamber are located five game elements Four of these 42 are of non-variable buoyancy such that they sink in water, and one 44 is of variable buoyancy. The latter is of generally cylindrical form and having a rigid or semi-rigid outer annulus 46 with semi-flexible side faces 48, 50, with air trapped and sealed within the hollow structure thus defined. Hook means 52 is provided on game element 44 to co-operate with complementary hook means 54 on the game elements 42 so that these hook means can interact, for a purpose to be described.

In use, chamber 12 is completely filled with water through filler 14. Pumps 26 and 28 are completely filled with water. Prior to closing filler 14 with a stopper, one pump is fully compressed, so that after releasing it with the filler closed and allowing it to return to its rest condition by virtue of its own resilience, both pumps are half full. Then, the pumps 26 and 28 can be used in either of two ways. By operating them in unison, pressure rises within chamber 12 and the variable buoyancy game element 44 can be caused to rise and fall within the chamber at will. Water from the pumps is accommodated by flexure of the side faces of chamber 12. When element 44 reaches the bottom, it can connect with the hook means of the other game elements and can then be caused (by releasing the pumps) to rise and convey same to the target area 56. In addition to this function, by discharging the pumps individually, liquid can be caused to circulate within the chamber anticlockwise or clockwise in the manner indicated by arrows 58, 60 to cause a momentum effect on the game elements 42 to effect movement of same. The weight distribution of game element 44 is such that its hook portion 52 is always lowermost. The game elements 42 each have three hook elements and are so constructed that at least one of these is always uppermost for engagement with the hook of game element 44.

Amongst other modifications which could be made in the above embodiment while remaining within the scope of the invention are the provision of variable amounts of air within the chamber according to requirements. For example, if only one pump were provided, it might still be possible to provide for variation of the buoyancy of one or more game elements while still providing momentum effects within the chamber by water discharge. Furthermore, by providing the game elements with magnetic means such as a magnetic ball or roller 62 within game element 44, it can be arranged for them to interact either for purposes of interconnection or, by interacting between two different game chambers or chamber-portions, interesting effects can be achieved, particularly by virtue of magnetic repulsion, where a repulsion effect exerted on a game element 44 carrying, suspended, a game element 42 might be sufficient to dislodge the latter. For this purpose two sets of game apparatus 10 could be held by the players with their chambers in contact while playing.

Modifications relating to the target area 56 include variations on the generally V-shaped target area, including the provision of ledge means, or indeed any other zone or resting place for the game elements. It would be possible to provide within the chamber, a maze through which the game elements have to be guided. Likewise, the game elements could, for example, be in the form of hoops to be lodged on a retaining spike or the like, or a variety of obstacles could be provided, or the variable buoyancy game element could be arranged to carry the other game elements and assemble them into a structure of some kind. Likewise, various simulated games could be provided, including various ball games such as football and basket ball. In connection with these, there could be provided externally controllable movable structures. For example, a goalie could be provided with a control shaft which the user actuates externally. Equally the chamber could be in the form of an annular transparent tunnel disposed horizontally with the pumps discharging into it generally tangentially so that the game elements can circulate. Several players could actuate several pumps simultaneously.

In addition, more than two pumps could be provided and the shape of the chamber could be varied considerably.

A preferred modification will now be described with reference to FIGS. 3 and 4, and certain optional features indicated in FIG. 1.

Figure 3:
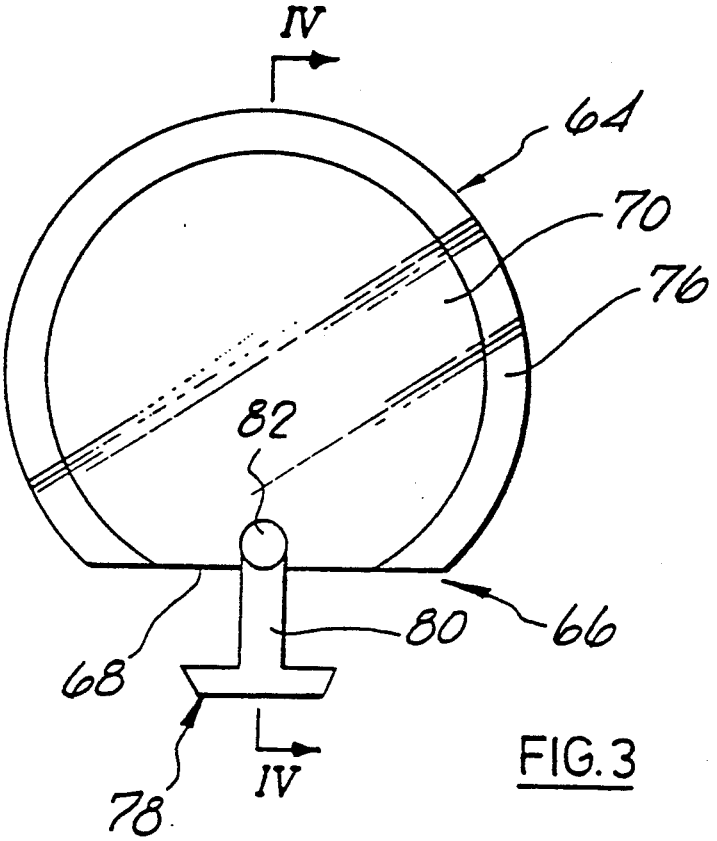
FIGS. 3 and 4 show, on a larger scale, views corresponding to those of FIGS. 1 and 2 of a modified variable buoyancy game element, FIG. 4 being a section on the line IV—IV in FIG. 3.
Figure 4:
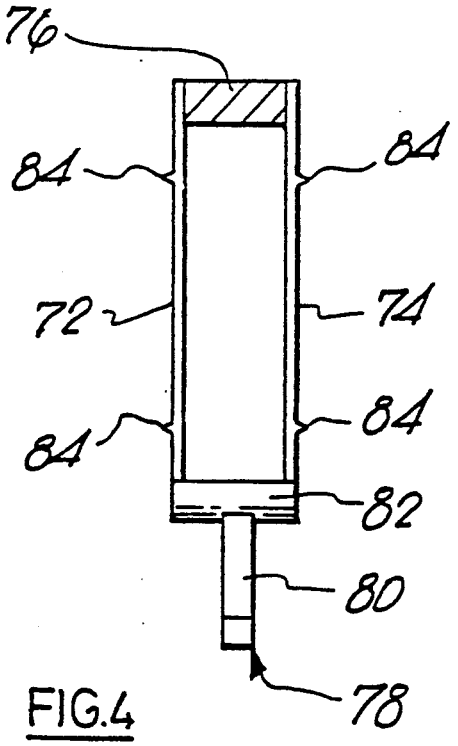

As shown in FIGS. 3 and 4, variable buoyancy game element 64, corresponding to game element 44, is otherwise constructed in a manner similar to the latter, but is formed with a truncated lower portion 66 defining an opening 68 through which water pressure is applied in use to the bubble of air trapped inside the chamber 70 defined by side wall 72, 74 and part-annulus 76. In this embodiment, the side wall 72, 74 need not be flexible as in the preceding embodiment.

Mounted so as to extend into opening 68 is a hook element 78, otherwise constructed as hook element 52, but having a somewhat longer stem portion 80 terminating in a T-piece 82 which is pivotally received in corresponding openings formed :n side walls 72, 74. Hook element 78 is formed of a material having a density such that it maintains the game element 64 in the attitude shown in FIG. 3 with the hook element lowermost. The hook element may be formed of a ferro-magnetic material, for purposes of magnetic interaction with other game elements, as described above.

As shown in FIG. 4, the flat side walls 72, 74 of game element 64 are formed with spaced outwardly-projecting dimples 84 to minimise surface contact effects as between the game element and the side faces of chamber 12.

In use, the water pressure applied to the bubble of air in chamber 70 effects compression of same and reduction of the buoyancy of game element 64 so that the use of the game proceeds in the manner already described, while the construction of the game element 64 is simplified A related modification indicated in FIG. 1 is the provision of a larger opening 86 in chamber 12, with a corresponding sealable stopper (not shown), the size of the opening being such that element 64 can be removed and shaken or otherwise treated to remove water which may enter the space 70 therein after a certain length of use Also shown in FIG. 1 are modified arrangements for the pumps 26, 28, whereby each pump is connected to chamber 12 only by its own single duct 88, 90, which connects to the chamber in the region of the top thereof. The valves 40 are dispensed with, and likewise the inlet ducts 32, 34. The directions of water discharge from ducts 88, 90 are indicated by arrows 92, 94 respectively. This arrangement improves the degree of control over the movement of the variable buoyancy game element.

A related modification is shown in the lower region of chamber 12 where a recessed portion 96 is indicated in broken lines, wherein the game elements 42 can rest in a location where they are slightly protected from the water momentum effects produced by the pumps 26 and 28.

I claim:

1. Game apparatus comprising:

a chamber for holding a liquid;

at least one movable game element for use within said chamber;

viewing means for viewing said game element within said chamber, and pump means operable to cause movement of said game element;

said movable game element being of variable buoyancy and said pump means being operable to cause movement of said game element within liquid contained in said chamber both by virtue of momentum of liquid within said chamber and by virtue of pressure changes applied to the liquid in said chamber to affect the buoyancy of said game element;

said game element further comprising a hollow structure having an opening whereby air trapped within the structure may be compressed by virtue of said pressure changes to change the buoyancy of said game element and weight means disposed in relation to said opening to maintain same in a downwardly facing attitude during use.

2. Apparatus according to claim 1 characterised in that said pump means comprises two pump elements operable individually to cause movement of liquid within said chamber and hence movement of said game element by virtue of liquid momentum, and said pump elements being operable in unison to effect pressure changes in the liquid in said chamber to change the buoyancy of said game element.

3. Apparatus according to claim 2 characterised by the provision of at least two game elements, one of said game elements being of non-variable buoyancy.

4. Apparatus according to claim 3 characterised by connection means on said game element of variable buoyancy for connecting to said other game element.

5. Apparatus according to claim 4 characterised in that said connection means comprises hook means on one or both of said game elements.

6. Apparatus according to claim 4 characterised in that said connection means comprises magnetic means.

7. Apparatus according to claim 1 comprising two or more game elements characterised in that said game elements comprise magnetic means whereby said game elements can magnetically interact.

8. Game apparatus comprising:

a chamber for holding a liquid;

at least one movable game element for use within said chamber;

viewing means for viewing said game element within said chamber, and pump means operable to cause movement of said game element;

said movable game element being of variable buoyancy and said pump means being operable to cause movement of said game element within liquid contained in said chamber both by virtue of momentum of liquid within said chamber and by virtue of pressure changes applied to the liquid in said chamber to affect the buoyancy of said game element;

said chamber further comprising a curved form whereby liquid in said chamber can circulate in a generally rotary manner, and said pump means is disposed so as to have a delivery direction with respect to said chamber so as to produce generally rotary movement of liquid therein.

9. Apparatus according to claim 8 characterised by a relieved portion formed in the curved peripheral profile of said chamber in the region thereof which is lowermost in use, to provide shelter means to protect a game element or elements therein from a current of liquid during use.

* * * * *